US009617864B2

(12) United States Patent
Firnhaber et al.

(10) Patent No.: US 9,617,864 B2
(45) Date of Patent: Apr. 11, 2017

(54) SEAL ASSEMBLY FOR A GUIDE VANE ASSEMBLY

(71) Applicant: UNITED TECHNOLOGIES CORPORATION, Farmington, CT (US)

(72) Inventors: Michael C. Firnhaber, East Hampton, CT (US); Enzo DiBenedetto, Kensington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 3 days.

(21) Appl. No.: 14/793,362

(22) Filed: Jul. 7, 2015

(65) Prior Publication Data

US 2016/0017739 A1 Jan. 21, 2016

Related U.S. Application Data

(60) Provisional application No. 62/026,985, filed on Jul. 21, 2014.

(51) Int. Cl.

| | |
|---|---|
| ***F01D 11/00*** | (2006.01) |
| ***F01D 5/02*** | (2006.01) |
| ***F01D 9/04*** | (2006.01) |
| ***F01D 17/16*** | (2006.01) |
| ***F04D 29/56*** | (2006.01) |

(52) U.S. Cl.

CPC ..... *F01D 9/041* (2013.01); *F01D 17/162* (2013.01); *F04D 29/563* (2013.01); *F01D 11/003* (2013.01); *F05D 2230/90* (2013.01); *F05D 2240/121* (2013.01)

(58) Field of Classification Search

CPC ..... F01D 5/18; F01D 5/14; F01D 9/04; F01D 9/02; F01D 11/00; F01D 25/12; F01D 5/30; F02C 7/12; F02C 7/18; F02C 7/00

See application file for complete search history.

(56) References Cited

U.S. PATENT DOCUMENTS

| | | | | |
|---|---|---|---|---|
| 2,444,293 | A * | 6/1948 | Holt | B64C 21/08 244/129.1 |
| 3,556,695 | A * | 1/1971 | Yamamoto | F01C 19/10 418/121 |
| 3,924,314 | A * | 12/1975 | Ferchland | F01C 19/04 277/357 |
| 3,990,810 | A * | 11/1976 | Amos | F01D 17/162 415/161 |
| 4,097,187 | A * | 6/1978 | Korta | F01D 17/162 415/161 |
| 4,575,322 | A * | 3/1986 | Paquet | F04C 27/02 418/96 |
| 6,045,325 | A * | 4/2000 | Horvath | F01D 5/148 277/637 |
| 6,619,916 | B1 * | 9/2003 | Capozzi | F01D 5/148 415/160 |

(Continued)

*Primary Examiner* — Igor Kershteyn

(74) *Attorney, Agent, or Firm* — Cantor Colburn LLP

(57) ABSTRACT

The present disclosure relates generally to a guide vane assembly including a first airfoil, including a first airfoil trailing edge, a second airfoil, including a second airfoil leading edge, positioned aft the first airfoil to create a gap therebetween, and a seal assembly disposed within the gap to engage the first airfoil trailing edge and the second airfoil leading edge.

13 Claims, 6 Drawing Sheets

(56) References Cited

U.S. PATENT DOCUMENTS

| | | | | |
|---|---|---|---|---|
| 7,713,042 | B1 * | 5/2010 | Rodgers | F01C 1/3446 123/243 |
| 2012/0163960 | A1 * | 6/2012 | Ress, Jr. | F01D 17/162 415/173.1 |
| 2013/0084166 | A1 * | 4/2013 | Klingels | F01D 11/005 415/173.1 |
| 2013/0256461 | A1 * | 10/2013 | Maenz | B64C 9/02 244/213 |
| 2015/0218957 | A1 * | 8/2015 | Klinetob | F01D 9/02 60/726 |

* cited by examiner

SEAL ASSEMBLY FOR A GUIDE VANE ASSEMBLY

CROSS REFERENCE TO RELATED APPLICATIONS

The present application is related to, and claims the priority benefit of, U.S. Provisional Patent Application Ser. No. 62/026,985 filed Jul. 21, 2014, the contents of which are hereby incorporated in their entirety into the present disclosure

GOVERNMENT LICENSE RIGHTS

This invention was made with government support by the United States Air Force. The government has certain rights in the invention.

TECHNICAL FIELD OF THE DISCLOSED EMBODIMENTS

The present disclosure is generally related to gas turbine engines and, more specifically, a seal assembly for a guide vane assembly.

BACKGROUND OF THE DISCLOSED EMBODIMENTS

Generally, in gas turbine engines an inlet guide vane may include a plurality of variable vanes of a strut-flap design to properly direct air flow to downstream airfoils, necessary to achieve high performance. The gap between the upstream strut and the downstream flap typically needs to be very small to prevent unacceptable leakage from the pressure side to the suction side. As a result, tight tolerances or individual custom fabrication is required for the strut-flap design; thus, increasing costs for manufacturing.

Improvements in the strut-flap design of an inlet guide vane is therefore needed in the art.

SUMMARY OF THE DISCLOSED EMBODIMENTS

In one aspect, a guide vane assembly is provided. The guide vane assembly includes a first airfoil, including a first airfoil trailing edge. In one embodiment, the first airfoil includes an airfoil selected from the group consisting of variable incidence and fixed. In one embodiment, the first airfoil trailing edge includes a slot disposed therein, wherein the slot is positioned substantially parallel to a first airfoil trailing edge longitudinal axis The guide vane assembly further includes a second airfoil, including a second airfoil leading edge, positioned aft the first airfoil to create a gap therebetween. In one embodiment, the second airfoil comprises an airfoil selected from the group consisting of variable incidence and fixed. In one embodiment, the second airfoil leading edge includes a slot, disposed therein, wherein the slot is positioned substantially parallel to a second airfoil leading edge longitudinal axis.

The guide vane assembly further includes a seal assembly disposed within the gap to engage the first airfoil trailing edge and the second airfoil leading edge. In one embodiment, the seal assembly is disposed within the slot. In one embodiment, the seal assembly includes a pressure mechanism and a seal, including a protruding side and a buried side, wherein the pressure component is in contact with the buried side. In one embodiment, the pressure component comprises a spring. In one embodiment, the seal includes a low-friction material. In one embodiment, the seal includes a coating disposed thereon. In one embodiment, at least a portion of the protruding side is arcuate. In one embodiment, the protruding side is in contact with the second airfoil leading edge. In one embodiment, the protruding side is in contact with the first airfoil trailing edge.

In one aspect, a gas turbine engine is provided. The gas turbine engine includes a compressor section and a plurality of guide vane assemblies, positioned within the compressor section. Each guide vane assembly includes a first airfoil, including a first airfoil trailing edge, and a first airfoil trailing edge longitudinal axis and a second airfoil, including a second airfoil leading edge, and a second airfoil leading edge longitudinal axis, wherein the second airfoil leading edge is positioned aft the first airfoil trailing edge to create a gap therebetween. The guide vane assembly further includes a slot disposed within the first airfoil trailing edge positioned substantially parallel to the first airfoil trailing edge longitudinal axis, and a seal assembly disposed within the slot to engage the second airfoil leading edge.

In one aspect, a gas turbine engine is provided. The gas turbine engine includes a compressor section and a plurality of guide vane assemblies, positioned within the compressor section. Each guide vane assembly includes a first airfoil, including a first airfoil trailing edge, and a first airfoil trailing edge longitudinal axis, and a second airfoil, including a second airfoil leading edge, and a second airfoil leading edge longitudinal axis, wherein the second airfoil leading edge is positioned aft the first airfoil trailing edge to create a gap therebetween. The guide vane assembly further includes a slot disposed within the second airfoil leading edge positioned substantially parallel to the second airfoil leading edge longitudinal axis, and a seal assembly disposed within the slot to engage the first airfoil trailing edge.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
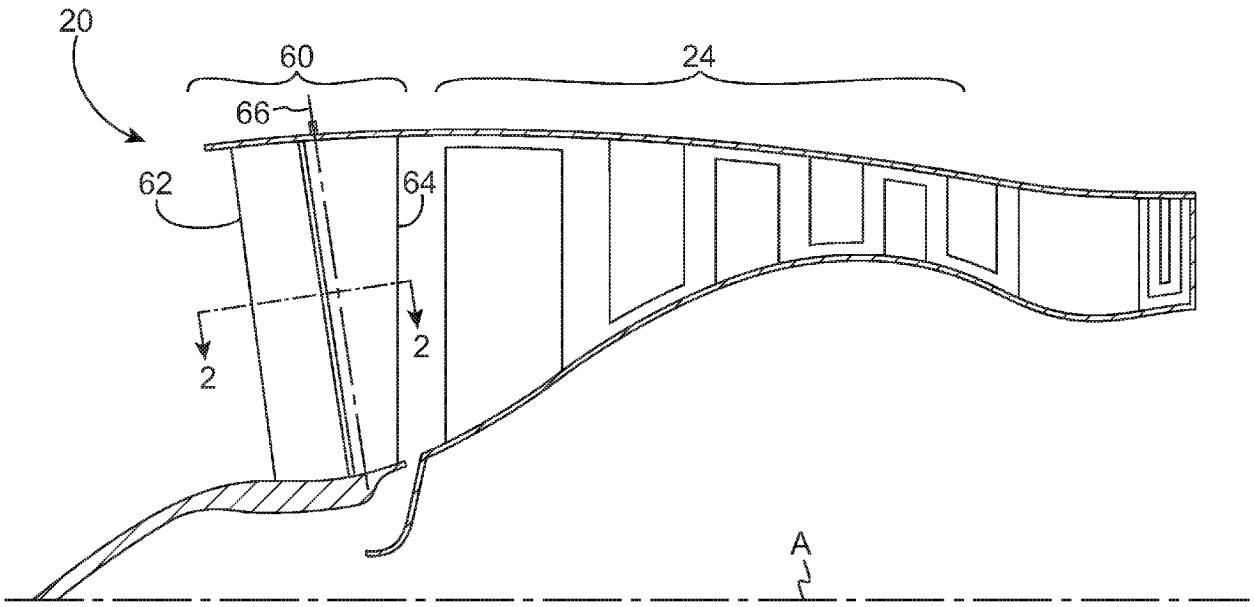
FIG. 1 is a sectional view of one example of a compressor section of a gas turbine engine in which the guide vane assembly of the present invention may be used.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows a compressor section of a gas turbine engine 20, such as a gas turbine used for power generation or propulsion, circumferentially disposed about an engine centerline, or axial centerline axis A. The engine 20 includes a multi-stage fan (compressor) 24, a high-pressure compressor (not shown), a combustion section (not shown), and a turbine (not shown). As is well known in the art, air compressed in the compressor 24 is mixed with fuel which is burned in the combustion section and expanded in turbine. The air compressed in the compressor 24 and the fuel mixture expanded in the turbine can both be referred to as a hot gas stream flow. A plurality of guide vane assemblies 60 (one shown) are disposed about the centerline axis A in front of the compressor 24. It will be appreciated that the guide vane assembly 60 may be disposed within any location of the compressor 24. Each of the guide vane assemblies 60 include an upstream airfoil 62 and a downstream airfoil 64. In one embodiment, the upstream airfoil 62 is selected from a group consisting of fixed and variable incidence. In one embodiment, the downstream airfoil 64 is selected from a group consisting of fixed and variable incidence. In the example shown, the variable incidence downstream airfoil 64 is pivotable about an axis 66 near the fixed upstream airfoil 62. It will be appreciated that a variable incidence upstream airfoil 62 may be pivotable about an axis (not shown). Although the guide vane assembly 60 of the present invention is shown and used with a particular type of gas turbine engine 20, the invention is not so limited, and can be used with any known gas turbine engine type, in any gas path location.

Figure 2:
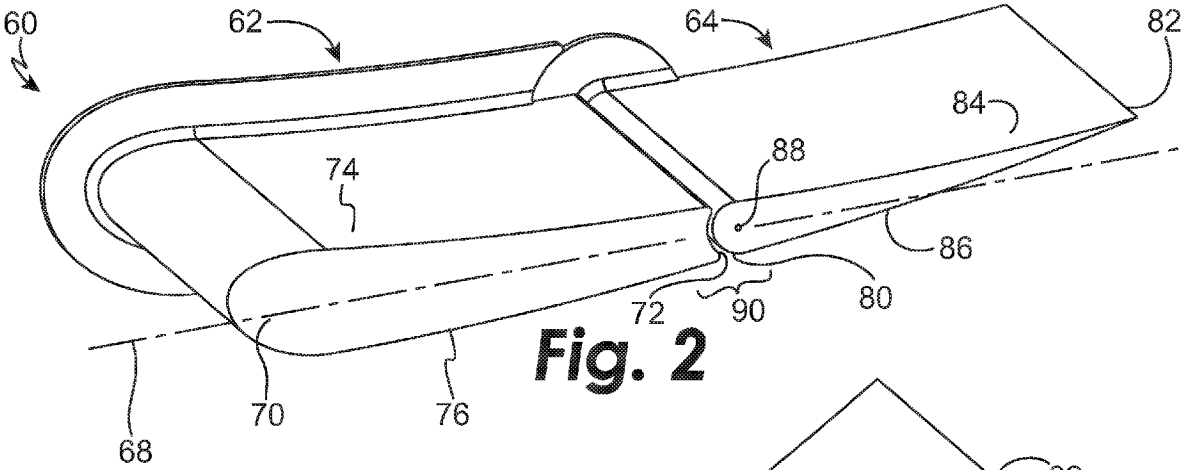
FIG. 2 is a section taken along the lines 2-2 of FIG. 1.

Referring to FIG. 2, when the guide vane assembly 60 is in a zero deflection position, the guide vane assembly 60 has a centerline 68, which in this particular embodiment evenly divides a symmetrical upstream airfoil 62; however, in particular applications, the upstream airfoil 62 may not be symmetrical. The upstream airfoil 62 includes an upstream airfoil leading edge 70 and an upstream airfoil trailing edge 72. Opposite upstream airfoil side surfaces 74, 76 extend from the upstream airfoil leading edge 70 to the upstream airfoil trailing edge 72. The upstream airfoil side surfaces 74, 76 each have continuous curvature from the upstream airfoil leading edge 70 to the upstream airfoil trailing edge 72.

As shown in the example embodiment, the downstream airfoil 64 need not be symmetrical about the centerline 68 at all. The downstream airfoil 64 includes a downstream airfoil leading edge 80 and a downstream airfoil trailing edge 82 which as shown in this embodiment may both be located on the same side of the centerline 68 in the zero deflection position. The downstream airfoil 64 includes a pressure side surface 84 and a suction side surface 86 between the downstream airfoil leading edge 80 and the downstream airfoil trailing edge 82. A pivot axis 88 of the downstream airfoil 64 may or may not be located on the centerline 68. In this particular embodiment, the pivot axis 88 is closer to the pressure side surface 84 of the downstream airfoil 64 (i.e. the direction toward which the downstream airfoil 64 can pivot); however, the particular location will depend upon each particular application. The downstream airfoil leading edge 80 is separated from the upstream airfoil trailing edge 72 by a gap 90.

Figure 3:
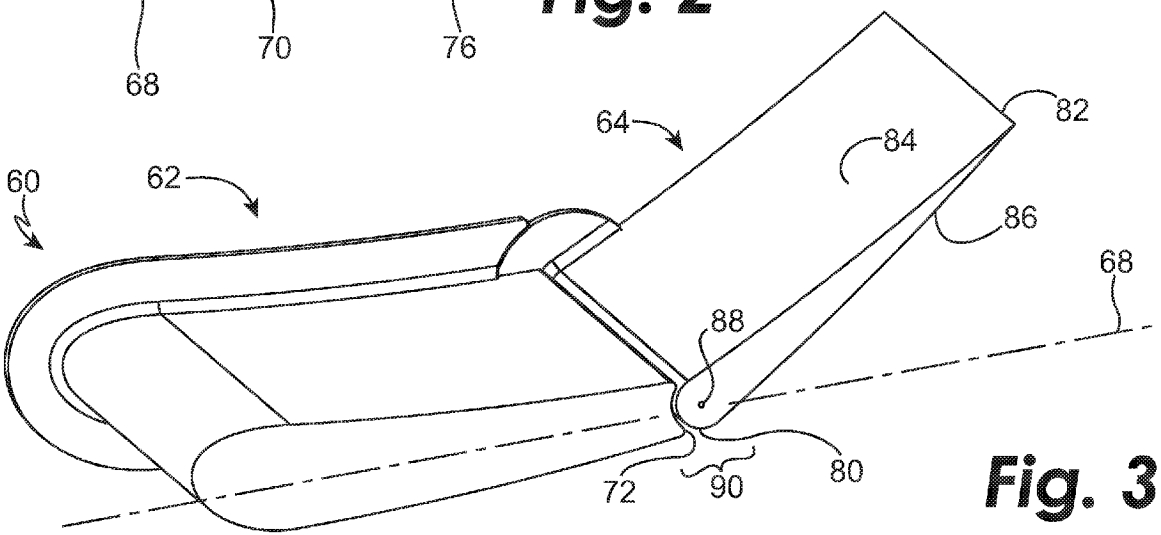
FIG. 3 is a view similar to FIG. 2 with the downstream airfoil in a fully deflected position.

The guide vane assembly 60 is shown with the downstream airfoil 64 pivoted to the fully deflected position in FIG. 3. As shown, the downstream airfoil leading edge 80 remains masked behind the upstream airfoil trailing edge 72 while the pressure side surface 84 and downstream airfoil trailing edge 82 project into the air flow to control and deflect the air flow.

Figure 4:
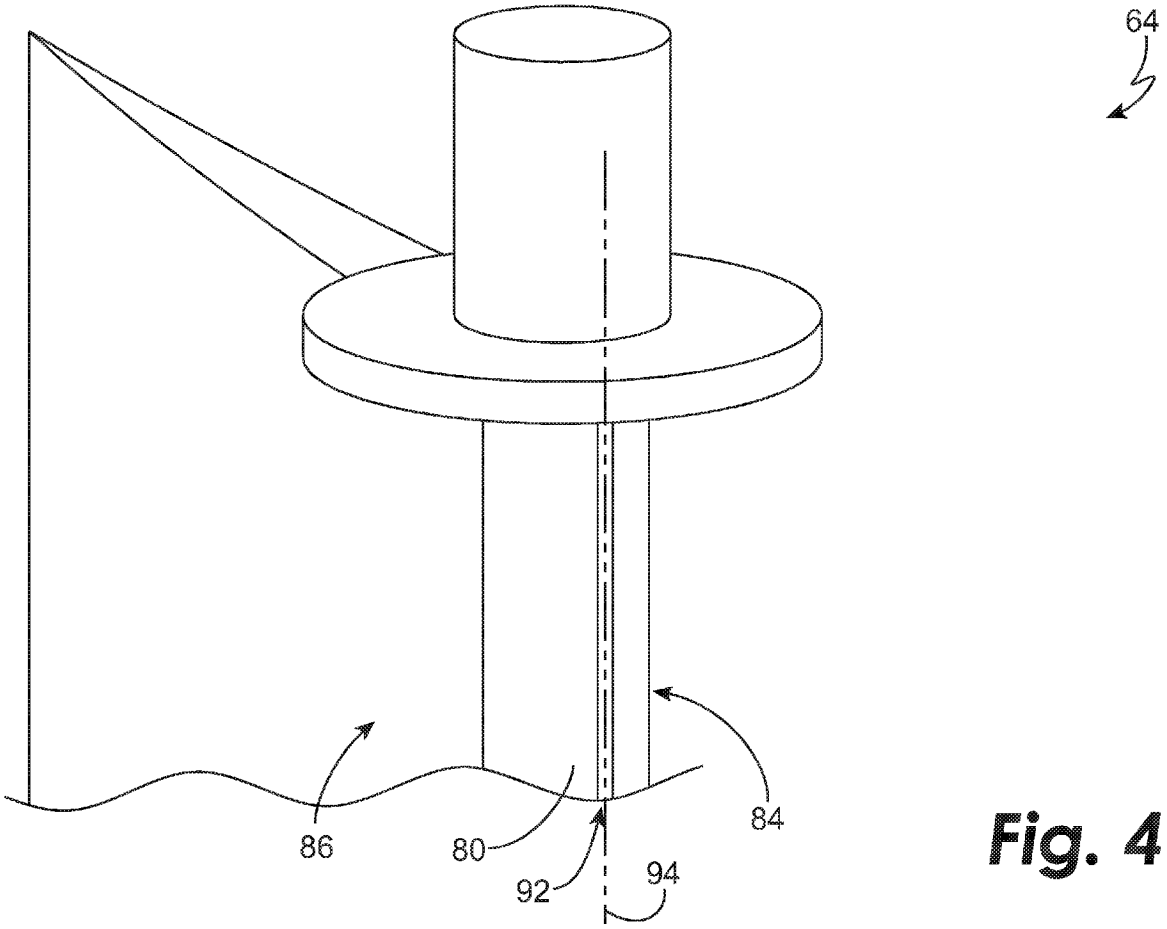
FIG. 4 is an enlarged perspective view of an embodiment of a downstream airfoil in FIG. 2.
Figure 5:
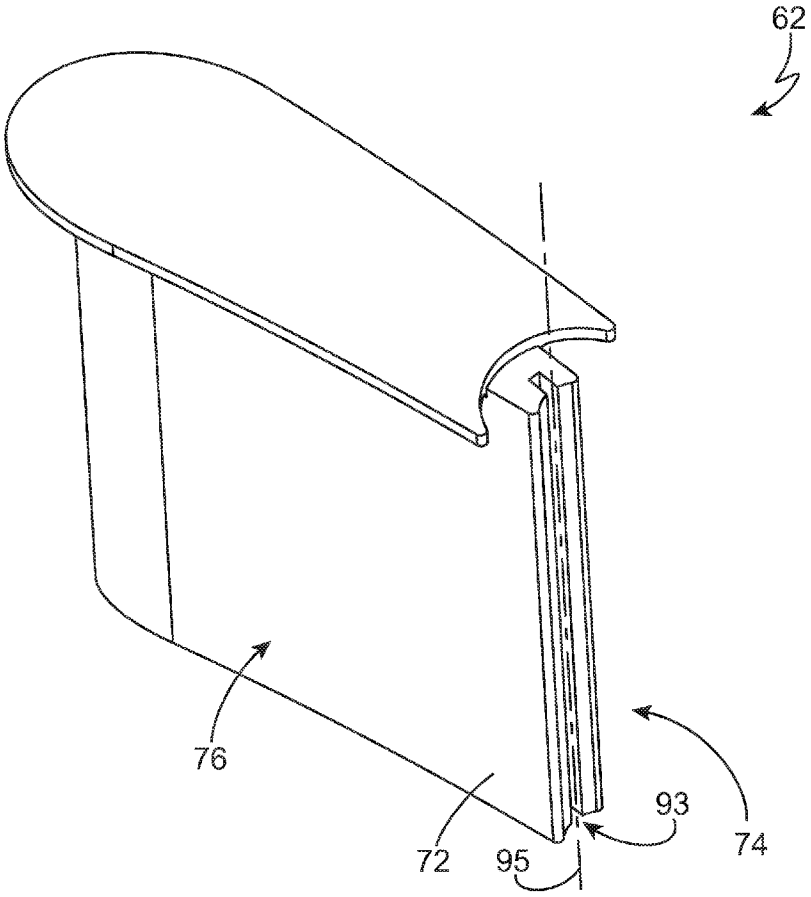
FIG. 5 is an enlarged perspective view of an embodiment of an upstream airfoil in FIG. 2.

In one embodiment, the downstream airfoil 64, as shown in FIG. 4, also includes a slot 92 extending substantially parallel to a downstream airfoil leading edge longitudinal axis 94 along the downstream airfoil leading edge 80. In another embodiment, as shown in FIG. 5, the upstream airfoil 62 includes a slot 93 extending substantially parallel to an upstream airfoil trailing edge longitudinal axis 95 along the upstream trailing edge 72.

Figure 6:
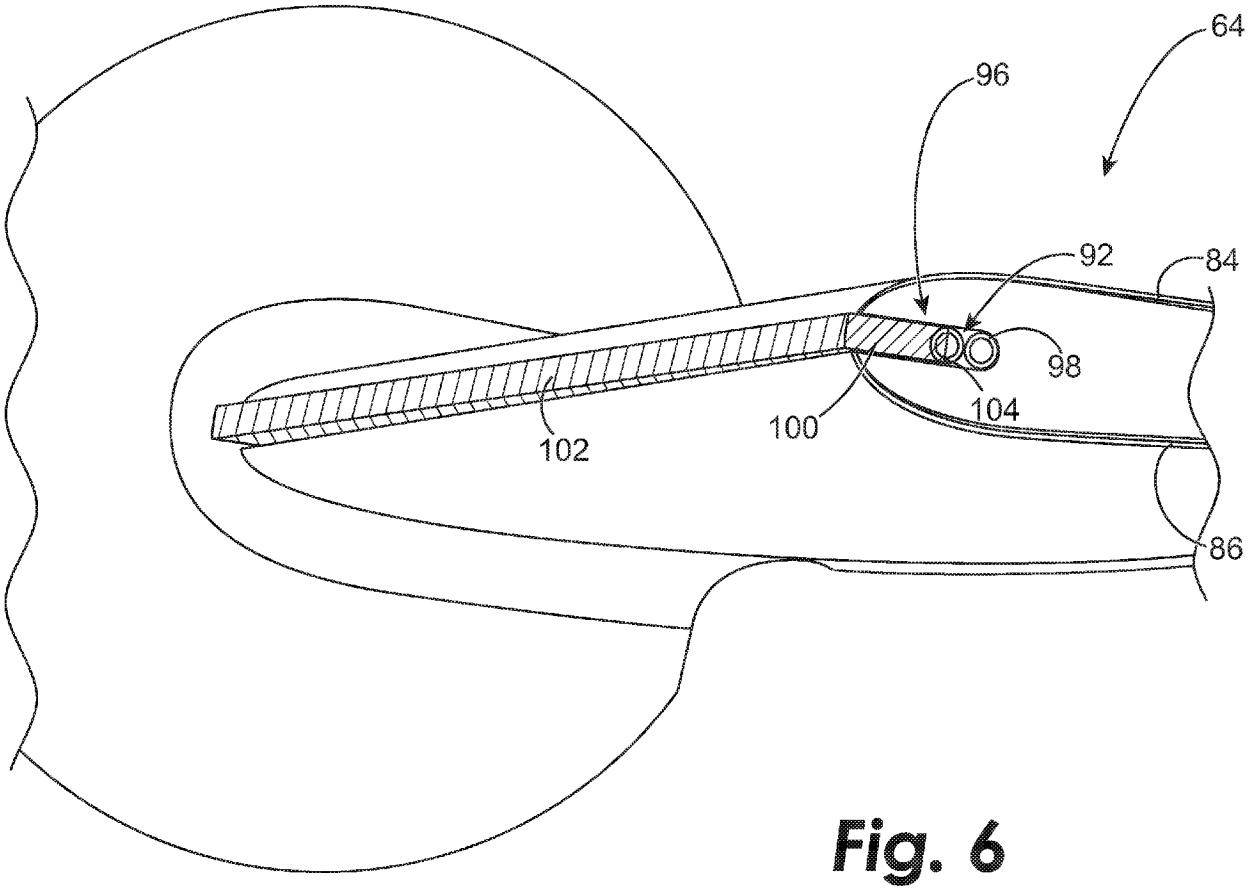
FIG. 6 illustrates an embodiment of the downstream airfoil according to the present disclosure.

Referring to FIG. 6, in one embodiment, a seal assembly 96 is disposed within slot 92. In another embodiment, the seal assembly 96 is disposed within slot 93. The seal assembly 96 includes a pressure mechanism 98 and a seal 100. In one embodiment, the pressure mechanism 98 is a spring. It will be appreciated that the spring may be composed of any spring-like materials, for example, elastomer and metal to name a couple of non-limiting examples. It will be appreciated that other pressure mechanisms 98 may also include any object that includes a low spring coefficient in order to maintain a constant pressure on the seal 100. It will also be appreciated that the pressure mechanism 98 may also include a fluid or air as it passes through the guide vane assembly 60. In one embodiment, the seal 100, including a protruding side 102 and buried side 104, such that the buried side 104 is in contact with the pressure mechanism 98. In one embodiment a ratio of exposure of the seal 100 includes a 1:3 ratio; therefore, at least 25 percent of the seal 100 protrudes from either the slots 92, 93. It will be appreciated that the amount of seal 100 protruding from either the slots 92, 93 may be less than or greater than 25 percent. In one embodiment, the seal 100 is composed of a low friction material (e.g. Polytetrafluoroethylene (PTFE), DuPont™ Teflon®, brass, bronze, or nickel to name a few non-limiting examples). In one embodiment, at least a portion of the protruding side 102 is arcuate. In one embodiment, the seal 100 may be coated with an anti-wear coating. In one embodiment, the upstream airfoil trailing edge 72 may be coated with an abrasion-resistant coating. In one embodiment, the downstream airfoil leading edge 80 may be coated with an abrasion-resistant coating.

Figure 7:
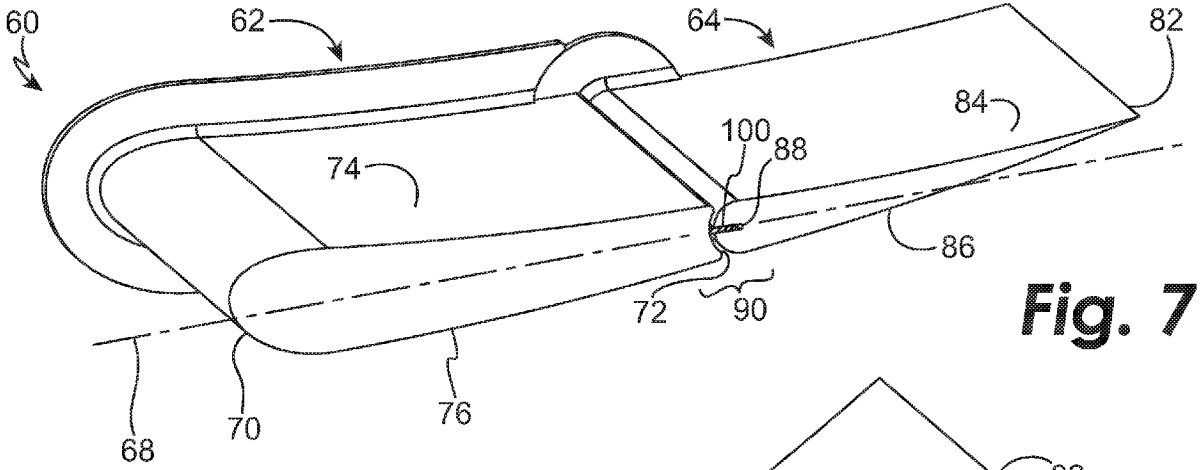
FIG. 7 is a section taken along the lines 2-2 of FIG. 1 showing the seal assembly according to the present disclosure.
Figure 8:
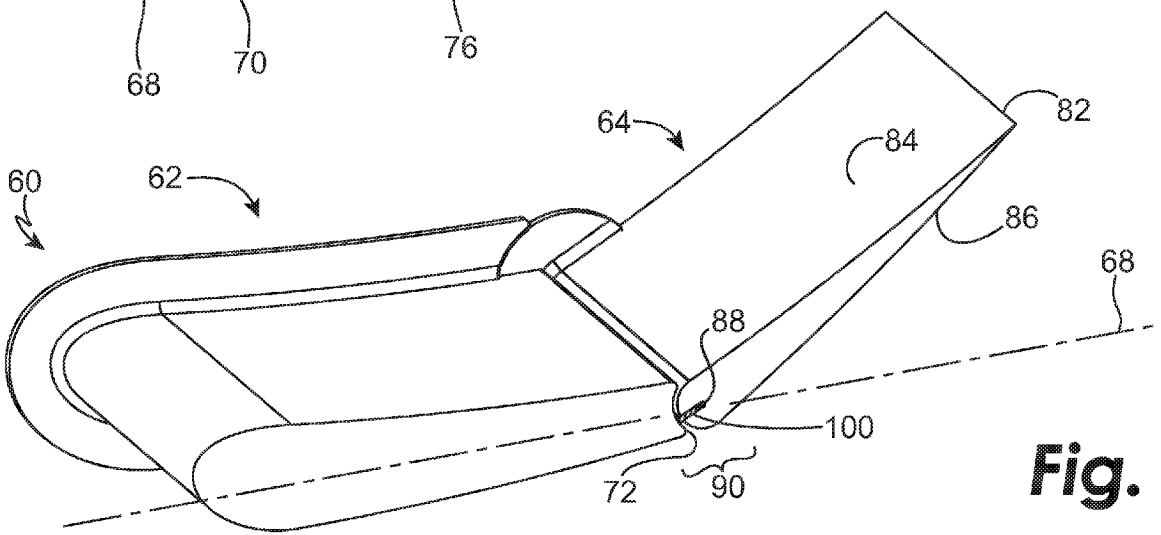
FIG. 8 is a view similar to FIG. 7 showing the seal assembly according to the present disclosure with the downstream airfoil in a fully deflected position.

In the example shown in FIGS. 7 and 8, the seal 100 is configured to be pressure loaded, so as to maintain a constant contact with the upstream airfoil trailing edge 78 throughout its entire range of motion, and such that this contact is maintained even as hardware begins to wear.

It will be appreciated that the seal assembly 96 is disposed within either the upstream airfoil trailing edge 72 or the downstream airfoil leading edge 80 to reduce unacceptable air leakage from flowing from the pressure side through gap 90 into the suction side of a compressor section 24.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A guide vane assembly for a gas turbine engine comprising:

a first airfoil, including a first airfoil trailing edge;

a second airfoil, including a second airfoil leading edge, positioned aft the first airfoil to create a gap therebetween; and a seal assembly disposed within the gap to engage the first airfoil trailing edge and the second airfoil leading edge, wherein the seal assembly comprises:

a pressure component; and a seal, including a protruding side and a buried side, wherein the pressure component is in contact with the buried side and the pressure component is configured to maintain contact between the protruding side and at least one of the first airfoil trailing edge and the second airfoil leading edge.

2. The guide vane assembly of claim 1, wherein the pressure component comprises a spring.

3. The guide vane assembly of claim 1, wherein the seal comprises a low-friction material.

4. The guide vane assembly of claim 1, wherein the seal comprises a coating disposed thereon.

5. The guide vane assembly of claim 1, wherein at least a portion of the protruding side is arcuate.

6. The guide vane assembly of claim 1, wherein the first airfoil comprises an airfoil selected from the group consisting of variable incidence and fixed.

7. The guide vane assembly of claim 1, wherein the second airfoil comprises an airfoil selected from the group consisting of variable incidence and fixed.

8. The guide vane assembly of claim 1, wherein the first airfoil trailing edge includes a slot, disposed within the first airfoil trailing edge, wherein the slot is positioned substantially parallel to a first airfoil trailing edge longitudinal axis, and wherein the seal assembly is disposed within the slot.

9. The guide vane assembly of claim 8, wherein the protruding side of the seal is in contact with the second airfoil leading edge.

10. The guide vane assembly of claim 1, wherein the second airfoil leading edge includes a slot, disposed within the second airfoil leading edge, wherein the slot is positioned substantially parallel to a second airfoil leading edge longitudinal axis, and wherein the seal assembly is disposed within the slot.

11. The guide vane assembly of claim 10, wherein the protruding side of the seal is in contact with the first airfoil trailing edge.

12. A gas turbine engine comprising:

a compressor section;

a plurality of guide vane assemblies, positioned within the compressor section, wherein each guide vane assembly comprising:

a first airfoil, including a first airfoil trailing edge, and a first airfoil trailing edge longitudinal axis;

a second airfoil, including a second airfoil leading edge, and a second airfoil leading edge longitudinal axis, wherein the second airfoil leading edge is positioned aft the first airfoil trailing edge to create a gap therebetween;

a slot disposed within the first airfoil trailing edge positioned substantially parallel to the first airfoil trailing edge longitudinal axis; and a seal assembly disposed within the slot to engage the second airfoil leading edge, wherein the seal assembly comprises:

a pressure component; and a seal, including a protruding side and a buried side, wherein the pressure component is in contact with the buried side and the pressure component is configured to maintain contact between the protruding side and the first airfoil trailing edge.

13. A gas turbine engine comprising:

a compressor section;

a plurality of guide vane assemblies, positioned within the compressor section, wherein each guide vane assembly comprising:

a first airfoil, including a first airfoil trailing edge, and a first airfoil trailing edge longitudinal axis;

a second airfoil, including a second airfoil leading edge, and a second airfoil leading edge longitudinal axis, wherein the second airfoil leading edge is positioned aft the first airfoil trailing edge to create a gap therebetween;

a slot disposed within the second airfoil leading edge positioned substantially parallel to the second airfoil leading edge longitudinal axis; and a seal assembly disposed within the slot to engage the first airfoil trailing edge, wherein the seal assembly comprises:

a pressure component; and a seal, including a protruding side and a buried side, wherein the pressure component is in contact with the buried side and the pressure component is configured to maintain contact between the protruding side and the second airfoil leading edge.

* * * * *